United States Patent [19]

Priesemuth

[11] 4,297,544

[45] Oct. 27, 1981

[54] PNEUMATICALLY OPERATING DELAY SWITCHES

[76] Inventor: Wolfgang Priesemuth, Postkamp 13, D-2210 Itzehoe-Nordoe, Fed. Rep. of Germany

[21] Appl. No.: 973,132

[22] Filed: Dec. 26, 1978

[30] Foreign Application Priority Data

Dec. 24, 1977 [DE] Fed. Rep. of Germany ..... 2758082

[51] Int. Cl.[3] ..... H01H 7/03

[52] U.S. Cl. ..... 200/34; 200/82 R; 267/114

[58] Field of Search ..... 200/34, 83 R, 82 R, 200/82 D; 267/113, 114

[56] References Cited

U.S. PATENT DOCUMENTS

| | | | |
|---|---|---|---|
| 1,059,013 | 4/1913 | Urquhart | 200/34 |
| 2,794,868 | 6/1957 | McMorran | 200/34 |
| 3,375,335 | 3/1968 | Schultz | 200/33 R |

FOREIGN PATENT DOCUMENTS

| | | |
|---|---|---|
| 1170043 | 5/1964 | Fed. Rep. of Germany . |
| 1197161 | 7/1965 | Fed. Rep. of Germany . |

*Primary Examiner*—J. V. Truhe
*Assistant Examiner*—Morris Ginsburg
*Attorney, Agent, or Firm*—Becker & Becker, Inc.

[57] ABSTRACT

A delay switch working pneumatically includes a piston and cylinder arrangement with the cylinder compartment being in communication with the outside air through a non-return valve and a throttle bore connected in parallel. The switch contacts include a contact spring connected to the piston and a portion of the inner cylinder wall which is made at least partially conducting. The piston is connected to an axially directed actuating pin through a first compression spring and is supported in the cylinder by a second compression spring which is weaker than the first compression spring. The cylinder may include a metallic sleeve which forms one switch connection and which has an insulating insert which the compact arrangement of a contact spring engages in the off state. In this arrangement, a second switch connection is electrically connected with the contact spring by way of the second compression spring.

5 Claims, 5 Drawing Figures

PNEUMATICALLY OPERATING DELAY SWITCHES

This invention relates to a delay switch working pneumatically with a piston-cylinder arrangement, the cylinder compartment of which is in communication with the outside air through a non-return or check valve and a throttle bore connected in parallel.

Delay switches working pneumatically of the above-mentioned kind are known in a large number of forms of construction, but these are invariably expensive to manufacture and consist of a large number of components which requires a considerable amount of space for installation. Because of the space required, known delay switches of this type are not suitable for all applications.

It is the object of the present invention to provide a delay switch working pneumatically in a particularly simple manner so that it has a cartridge-like appearance, can be produced with low costs and renders installation possible even in places were no delay switch could be installed hitherto. Delay switches according to the invention are particularly suited for use in the door contacts of motor vehicles, where it is desired that the internal vehicle light should not be switched off immediately after the door is closed. The delay switches hitherto known for door contacts work with an additional electronic system or with corresponding time-delayed relays, which could be accommodated in the vehicle door or in the vehicle frame separately from the installation space.

In order to solve the above-mentioned problem, the delay switch according to the invention is characterised in that the switch contacts comprise a contact spring connected to the piston and engaging the inner wall of the cylinder and a portion of the inner cylinder wall which is made at least partially conducting and that the piston is connected to an axially directed actuating pin through a first compression spring and is supported in the cylinder with a second compression spring which is weaker than the first compression spring. In this case, the switch housing can be a sleeve forming the pneumatic cylinder in which the piston slides in the form of a cylindrical cup, the piston being connected to the contact spring at its end adjacent to the cylinder compartment and forming a holding extension for the second compression spring which then also forms a conducting connection between the bracket spring and the switch connection taken out of the housing.

The sleeve-like construction of the housing also affords the possibility of accommodating an insert in the bottom portion of the housing in a particularly advantageous manner, which insert serves to take out the one switch contact in an insulated manner and receives a central throttle bore and an annular non-return valve surrounding the throttle bore.

Further details and features are apparent from the following detailed description and the accompanying drawing in which a preferred form of embodiment of the invention is illustrated by way of example.

Figure 2:
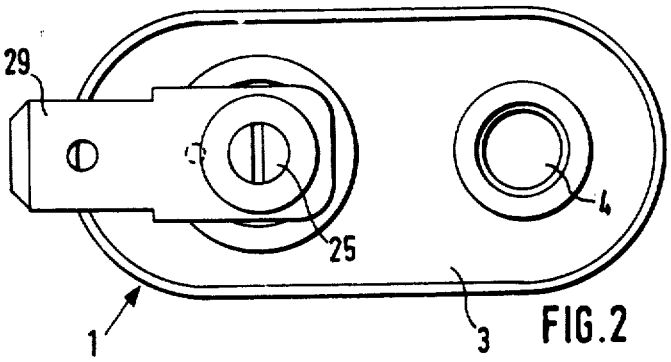
FIG. 1 shows a cross-section through a delay switch according to the invention and FIG. 2 shows a view of FIG. 1 from below.

The delay switch, which is illustrated greatly enlarged in the drawings, is provided in the form of a lighting door switch for motor vehicles. The delay switch is accommodated in a tubular metal housing 1 which consists of a sleeve portion 2 and an attachment strap 3. In the attachment strap 3, which also forms the earth connection of the switch, there is a screw bore 4 for an attachment screw. The sleeve portion 2 of the switch comprises a guide bore 5 for an axially movable actuating pin 6, the upward movement of which is prevented by an annular flange 7. The greater part of the sleeve portion forms the pneumatic cylinder 8 in which a cup-shaped piston 9 is inserted. Between an abutment 10 on the annular flange 7 of the actuating pin 6 and an abutment 11 at the bottom 13 of the cup-shaped piston 9 there is a relatively strong helical compression spring 12 which transmits the actuating forces from the actuating pin 6 to the piston 9. The piston 9 is inserted in the pneumatic cylinder 8 with a sealing sliding fit.

A holding extension 15 for a bracket spring 16 is formed at the under side of the bottom 13 of the piston. The bracket spring 16 is insulated with respect to the abutment 11 at the bottom 13 of the cup-shaped piston by way of a disc 14 of insulating material. The disc 14 of insulating material can be omitted if the cup-shaped piston 9 consists of insulating material, for example a plastics material.

The actual switch contacts are formed by the inner wall **8*a* of the pneumatic cylinder and said bracket spring 16. The bracket spring 16 is constructed in the form of a metal strip which has angled sliding contacts at opposite ends, which contacts come to bear against opposite sides of the inner wall 8*a*** of the metal housing while the contacts are being spread apart.

At the bottom of the housing 1 there is a cup-shaped insert 17 of insulating material and a metallic abutment 18. Between this abutment 18 and the holding extension 15 of the bottom 13 of the piston there is a second helical compression spring 19 which is made weaker than the above-mentioned helical compression spring 12 at the other side of the piston. The helical compression spring 19 connects the bracket spring 16 to the metallic abutment 18 for electrical conduction, so as to establish an electrical connection to the second switch connection.

At its upper portion, said insert 17 of insulating material forms an insulated lining 26 of the inner wall **8*a* of the pneumatic cylinder which is provided with a recess in the region of the lining. The insulating lining 26 is so dimensioned that its inner wall extends flush with the inner wall 8*a* of the pneumatic cylinder. Resting on this insert 17 of insulating material, which rests on a flange 20 of the housing 1, is the metallic abutment 18. A neck portion 27 of the insert 17 of insulating material and a neck portion 28 of the metallic abutment 18 project from the bottom opening of the housing 1. In this manner, the neck portion 28 is insulated with respect to the housing 1 so that it can serve as a switch connection, as illustrated and can carry a contact lug 29. In the interior of the metallic abutment 18 there is a throttle bore 24 in front of which, in a larger threaded bore 23 in FIG. 1, there is a throttle screw 25 which renders it possible to regulate the effective throttle opening at the throttle bore 24. Between the metallic abutment 18 and the step face of the insert 17 of insulating material, in a gap of correspondingly large dimensions, there is an annular non-return valve flap 30 which can cover an air inlet 22 including an inlet extension 21 of the insert 17** of insulating material.

The delay switch according to the invention works as follows. In the position of rest illustrated in FIG. 1, the bracket spring 16 acts on the inner wall 8*a* of the metallic housing 1. As a result, the contact lug 29, through the neck portion 28 of the metallic abutment 18, and the helical compression spring 19 are in communication with the bracket spring 16 and the housing 1 and the attachment strap 3 connected to earth. If the actuating pin 6 is pushed inwards, the cup-shaped piston cannot move at first because the volume of air occluded in the cylinder compartment 8*b* cannot escape immediately. The air inlet 22 is closed by the non-return valve 30 through the excess pressure developing in the cylinder compartment 8*b* so that the air can only escape from the cylinder compartment 8*b* through the throttle bore 24. As a result of the air cushion, the relatively strong helical compression spring 12 is compressed when the actuating pin 6 is pushed in. If the actuating pin 6 remains in the switching-on position, the cup-shaped piston and with it the bracket spring 16, travels slowly downwards, while the air occluded in the cylinder compartment 8*b* escapes slowly through the throttle bore 24. As soon as the bracket spring 16 slides off the metallic wall 8*a* of the pneumatic cylinder and impinges on the insulating lining 26, the connection between contact lug 29 and earth connection is interrupted. The switch is then in the off position in which the stronger helical compression spring 12 is substantially relaxed and the weaker helical compression spring 19 is compressed. If the actuating pin 6 is now released again or if a vehicle door with such a delay switch is opened, the helical compression spring—apart from slight friction—can move the piston 9 and the bracket spring 16 upwards substantially without delay until the switch position of FIG. 1 is reached again. Thus the bracket spring 16 slides almost instantaneously off the lining 26 of insulating material and again makes contact with the conducting wall 8*a* of the pneumatic cylinder.

According to a modified form of embodiment of the invention, the switch housing may also be made of plastics material, in which case the inner wall 8*a* of the pneumatic cylinder 8 is then metallized in the region on which the bracket spring 16 acts in the one state. If a reverse switching function is desired, the insulating and conducting portions of the pneumatic cylinder wall can be exchanged with another.

Figure 3:
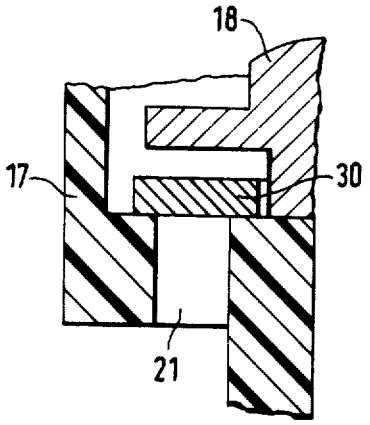
FIG. 3 shows an enlarged detail of a closed valve flap with a downwardly moved piston.

FIG. 3 shows an enlarged detail of a closed valve flap 30 with a downwardly moved piston 9.

Figure 4:
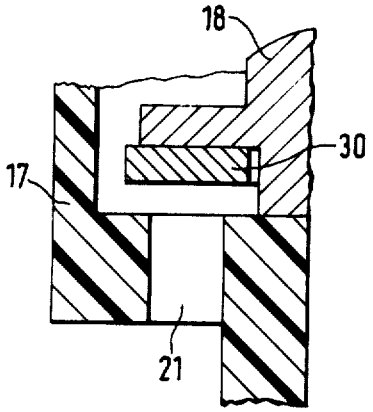
FIG. 4 is a view corresponding to the illustration of FIG. 3 with an opened valve flap with an upwardly moved piston.

FIG. 4 is a view corresponding to the illustration of FIG. 3 with an opened valve flap 30 with an upwardly moved piston 9.

Figure 1:
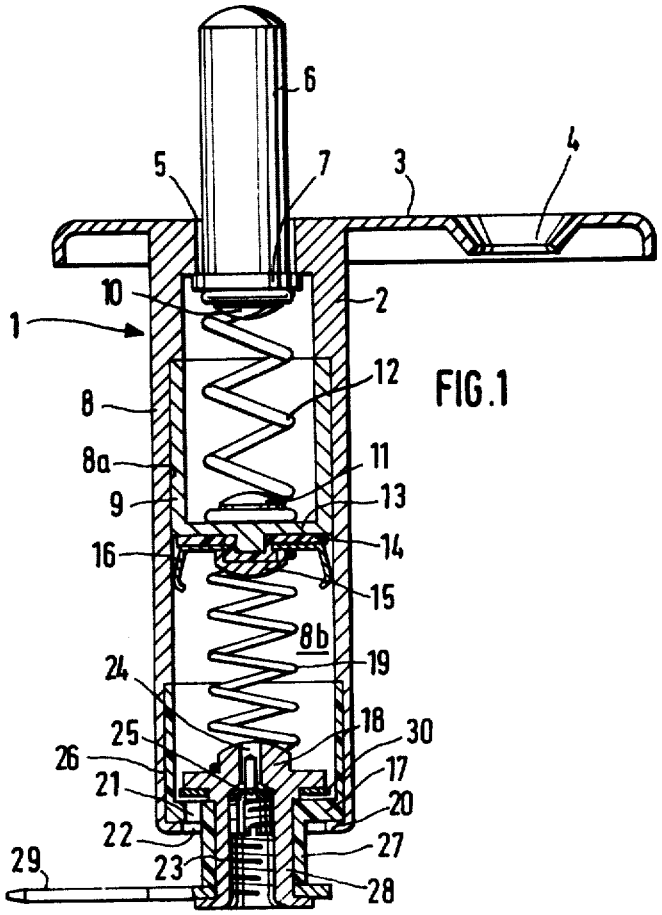
Figure 5:
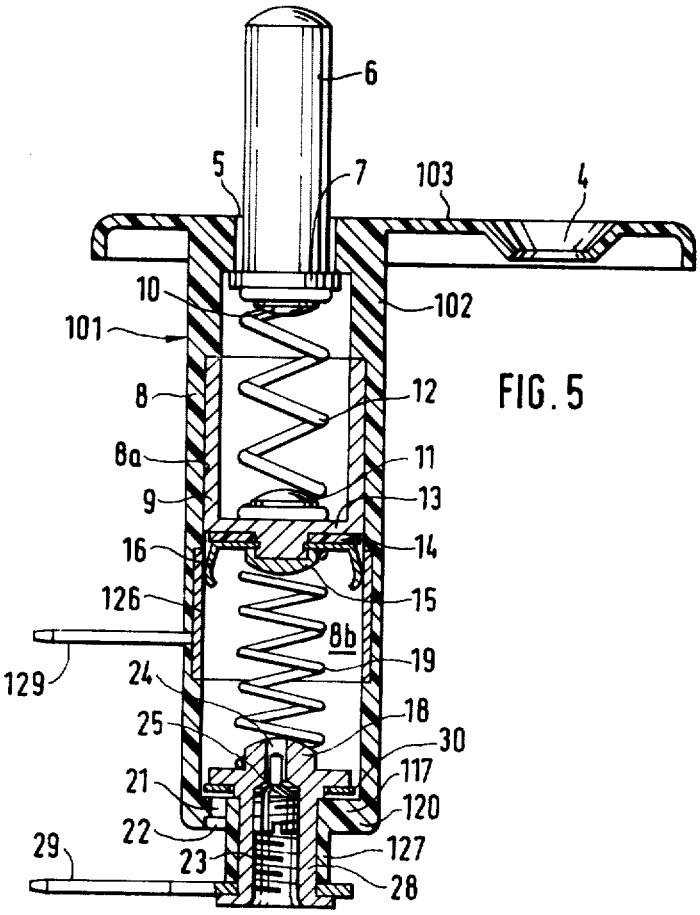
FIG. 5 shows a modification of the embodiment of FIG. 1 with which a metal housing is replaced by a synthetic material housing having a metal insert as a counter contact for a contact spring.

FIG. 5 shows a modification of the embodiment of FIG. 1 with which a metal housing 1 is replaced by a synthetic material housing which contains a metal insert 126 as a counter contact for the contact spring 16. With the embodiment of FIG. 5, the metal housing 1 and the construction element 2, 3, 20 thereof are replaced by corresponding structural parts 101, 102, 103, 120. In this synthetic material housing there are integrated also the construction elements 117 and 127 corresponding to these construction elements 17 and 27 previously set forth as being made of synthetic material. In place of the synthetic material insert 26 with the metallic embodiment according to FIG. 1, there is now provided a cylindrical insert 126 injected into the synthetic material housing and this insert 126 is provided with a radially outwardly projecting connection contact 129. The conducting connection between the switch contacts now extends with this embodiment according to FIG. 5 from the contact 129 by way of the metallic insert 126, the bracket spring 16, the spring 19, the metallic insert 18 and the neck parts 28 thereof to the other connection 29.

The present invention is, of course, in no way restricted to the specific disclosure of the Specification and drawings, but also encompasses any modifications within the scope of the appended claims.

What is claimed is:

1. A pneumatically operating delay switch arrangement including a pneumatic piston cylinder means provided with an insulating cylinder bottom and an inner wall having an at least partially conducting portion and having a cylinder compartment in communication with outside air through a check valve and a throttle bore connected in parallel therewith and having a piston operatively connected with switch contacts comprising slide contacts as the switch contacts formed by a bracket spring rigidly connected with said piston and engaging the inner wall of the pneumatic piston-cylinder means and formed by said at least partially conducting portion of said inner wall, a first compression spring means as well as a second compression spring means located in the cylinder compartment, said second compression spring means being weaker than the first compression spring means, and an outer connection including a contact lug and a neck portion of a metallic abutment passing through the insulating cylinder bottom along with said second compression spring means having electrically conductive joinder to said bracket spring.

2. A switch arrangement according to claim 1 in which said cylinder bottom is a cup-formed insulation insert, and a metallic valve means is located in said cup-formed insulation insert including an annular check valve flap and a throttle bore therewith as well as forming a conductive connection between said second compression spring means and said outer connection.

3. A switch arrangement according to claim 1, which includes a switch housing, said pneumatic piston-cylinder means being a part of said switch housing, said switch housing being electrically conductive and forming one outer connection, and an insulating lining provided as a part of the cylinder compartment upon which said spring bracket moves in turned-off condition.

4. A switch arrangement according to claim 1 in which the pneumatic piston-cylinder means is part of a switch housing which comprises insulating material, and a metallic lining in a part of said cylinder compartment, said bracket spring moving upon said metallic lining in turned-on condition.

5. A compact arrangement of a delay switch including a switch housing and working pneumatically with a piston-cylinder means including a piston and cylinder having a bottom as well as an inner wall and a portion thereof cylinder compartment which is in communication with outside air through a non-return valve and a throttle bore connected in parallel therewith, characterised in that the switch contacts comprise a contact spring connected to the piston and engaging the inner wall of the cylinder and a portion of the inner cylinder wall which is made at least partially conducting, said piston being connected to an axially directed actuating pin by a first compression spring and being supported in the cylinder by a second compression spring which is weaker than the first compression spring, said contact spring being connected, through the second compression spring to a switch connection taken out of the bottom of the cylinder, for conduction, said bottom of the cylinder being formed by a stopper-like insert which supports the second spring, being insulated with respect to the conducting portion of the cylinder wall and forms the switch connection, said insert being provided with a central throttle bore, a regulating screw engaging in the throttle bore and an annular non-return valve flap surrounding the throttle bore and lying in front of an air inlet provided in the bottom of the housing, said switch housing being formed of insulating material and a portion of the wall of the cylinder compartment comprising a metallic lining onto which the contact spring runs in the on state.

* * * * *